US005242571A

United States Patent [19]

Sein et al.

[11] Patent Number: 5,242,571

[45] Date of Patent: Sep. 7, 1993

[54] METHOD AND APPARATUS FOR THE ELECTROLYTIC PRODUCTION OF COPPER WIRE

[75] Inventors: Carlos E. R. Sein, Lima, Peru; William J. Borzick, Sandy, Utah

[73] Assignee: ASARCO Incorporated, New York, N.Y.

[21] Appl. No.: 966,416

[22] Filed: Oct. 26, 1992

[51] Int. Cl.[5] ..... C25D 7/06

[52] U.S. Cl. ..... 205/138; 204/206

[58] Field of Search ..... 205/138; 204/206

[56] References Cited

U.S. PATENT DOCUMENTS 3,676,322 7/1972 Kamata ..... 204/206
4,155,816 5/1979 Marencak ..... 204/231
4,196,059 4/1980 Petrov ..... 204/261
4,395,320 7/1983 Kasashima ..... 204/206

*Primary Examiner*—T. M. Tufariello
*Attorney, Agent, or Firm*—John J. Tomaszewski; Kenneth A. Koch

[57] ABSTRACT

A method and apparatus are disclosed for producing copper wire by electrolytically engrossing a copper starting wire. Basically the invention utilizes an electrolytic tank employing a pair or pairs of shafts positioned externally of the tank upon which a minimum of one but generally at least two starting wires are transported on each pair for transfer of the wires through the tank. Multiple tanks, e.g., 10 to 1000 or more, may be used in a single facility for refining or electrowinning processes depending on the quantity of copper wire desired to be produced.

41 Claims, 4 Drawing Sheets

METHOD AND APPARATUS FOR THE ELECTROLYTIC PRODUCTION OF COPPER WIRE

BACKGROUND OF THE INVENTION

The present invention relates to a continuous commercial electrolytic process for the engrossment of wire and, in particular, to a method and an apparatus for the electrorefining or electrowinning of metals, particularly copper, by electrodepositing the metal onto a metal starting wire during the process.

The conventional method of producing copper wire used throughout industry starts with pure copper plates commonly named "cathodes" which are about 3.3 ft (1000 mm) square and about ⅝ inch (15 mm) thick. The cathodes are formed during electrorefining or electrowinning operations by electrodeposition of pure copper on thin starting sheets of refined copper or on a metal such as stainless steel from which the deposit is stripped. These starting sheets, also measuring about 3.3 ft square but about 0.04 inch (1 mm) thick, have to be intermittently introduced into the electrolytic tanks as the engrossed refined cathodic plates are removed as finished product, both operations using manual work. In addition, the electrolysis is generally carried out at low current densities which is defined as the amperage applied to the tanks spread over the immersed surface area of the total number of the cathodic starting sheets present (cathode current density), or expressed in terms of the wetted areas of the crude copper anodes being refined or inert anodes in electrowinning operations (anode current density). Low densities are generally inefficient since the quantity of copper deposited is directly proportional to the amount of current applied. Notwithstanding, higher current densities are not generally used in the present art to improve throughput and decrease the cost of producing a unit of copper as the quality of the plated metal thereby obtained in conventional tanks would be debased and/or the resulting roughness of the product become undesirable.

To manufacture wire the cathodes then have to be melted, cast and hot rolled in a separate and complex facility to produce rod which is normally 5/16 inch (7.94 mm) in diameter. This rod is then converted to wire, e.g., electrical wire. The first step in this process is the "rod breakdown" where the rod is cold drawn to about AWG #14. (1.628 mm). The intermediate wire after "rod breakdown" is further cold drawn to the final product size. During the cold drawing operation the wire must be periodically annealed.

Thus, the conventional method of copper wire production starting with an electrorefining or electrowinning process consumes much energy and requires extensive labor and capital costs. The melting, casting and hot rolling operations also subject the product to additional oxidation and potential contamination from foreign materials such as refractory and roll materials which can subsequently cause problems to the wire drawers generally in the form of wire breaks during drawing.

The prior art has attempted to overcome the problems associated with the conventional methods for the production of wire and rod by utilizing continuous electrolytic processes whereby a pure copper starting wire is engrossed by passing the wire as a cathode through a tank containing electrolyte and using impure copper or lead as the anode. Many patents have been issued over the years in this area but the need exists for more efficient electrolytic wire making processes and apparatus which are commercially and economically feasible.

U.S. Pat. No. 1,058,048 describes electrodepositing copper onto wire by advancing the wire in a vat of electrolyte in a continuous series of endless travelling loops. U.S. Pat. No. 4,097,354 shows the continuous electrolytic plating of metal using moving cathodes and anodes in the form of sheets or plates. U.K. Patent No. 1,172,906 is directed to producing copper wire by electrodeposition in a continuous process comprising continuously forming an elongated member by electrodeposition on a moving cathode surface, stripping the member from the cathode surface and passing it through electrolyte adjacent to anodes to build up its thickness. U.K. Patent No. 1,398,742 shows a continuous process for electrodepositing copper onto wire by guiding the wire as a cathode through the bath by a plurality of rolls describing any adequate path and, upon emerging from the bath, passing the wire through washing means. U.S. Pat. No. 4,196,059 discloses a method and an apparatus for continuously introducing separate thin copper wires as a cathodic starting or base surface for one pass through a tank for refining impure copper anode blocks thereby engrossing said wires by electrolytic deposition to a large diameter rod (about 20 mm). It is claimed that the process may be operated at high current densities without contamination of the refined rod by the normal impurities found in the anode slime residues.

U.S. Pat. No. 4,395,320 also discloses an electroplating apparatus to engross a wire consisting of a cascade of electrolytic baths separated by rollers pressing on the wire being engrossed in order to smooth its rough surface caused by the high current densities utilized in the process.

U.S Pat. No. 3,676,322 discloses an apparatus and method for continuously producing an electrolytically plated wire which comprises passing a single wire repeatedly in and out of an electrolyte contained in tanks positioned between external guide rolls. The rolls pass the wire continuously through the tanks in a stepwise manner back and forth between the guide rolls with the wire as the cathode and anode electrodes to effect electrolytic plating.

U.S. Pat. No. 4,891,105 shows a method and apparatus for engrossing a single copper wire by passing the wire a plurality of times around electrical conducting external motorized shafts to form at least a pair of wire curtains in the tank. The wire traverses a number of lengthwise passageways a number of times in opposite directions during the engrossing process.

U.S. Pat. No. 3,929,610 shows the electroformation of metallic strands of infinite length by continuous electrodeposition of metal on a conductive strip having a narrow, closed-loop plating surface.

U.S. Pat. No. 4,053,377 is not directed to producing wire and is of interest to show the electrodepositing of copper onto a cathode under conditions of non-turbulent electrolyte flow achieved by means of a venturi section and a single cathode-anode pair.

The disclosures of all of the above patents are hereby incorporated by reference.

While the prior art has made many advances in this art, the need exists for improved methods to commercially produce copper wire and it is an object of the present invention to provide apparatus and processes for effectively and efficiently engrossing large quantities of wire electrolytically.

Other objects and advantages of the invention will be readily apparent from the following description which will be directed for convenience to the engrossment of copper wire with copper.

SUMMARY OF THE INVENTION

It has now been discovered that a starting material such as wire may effectively and efficiently be engrossed electrolytically by employing an apparatus in which the wire is transported horizontally through the apparatus in the form of vertical curtains and which has a number of improvements over the prior art. In one embodiment at least one set or pair of external drive shafts located at opposite ends of a tank are used upon which at least two wires are transported and are passed repeatedly in and out of a specially designed electrolytic plating tank at a desired speed and/or current density and/or number of passes until the desired size engrossed wires are obtained. In another embodiment, multiple sets of external drive shafts are employed with single or multiple starting wires thereon for engrossment. In either single or multiple shaft embodiments, converging rollers may be used to alter the path of the wire and to pack the wire curtains horizontally closer together. Another embodiment employs wire converging rollers and uses the rollers in conjunction with multiple sets of specially placed, e.g., angularly or triangularly, external drive shafts, which embodiments minimize the tank size needed to process a particular number of wires.

DETAILED DESCRIPTION OF THE INVENTION

The present invention relates to a method and apparatus for the continuous production of engrossed wire by electrodeposition of metal onto a cathodic starting wire using impure metal or inert materials such as lead for the anode and will be, for convenience, directed to copper metal and copper starting wire.

Figure 1:
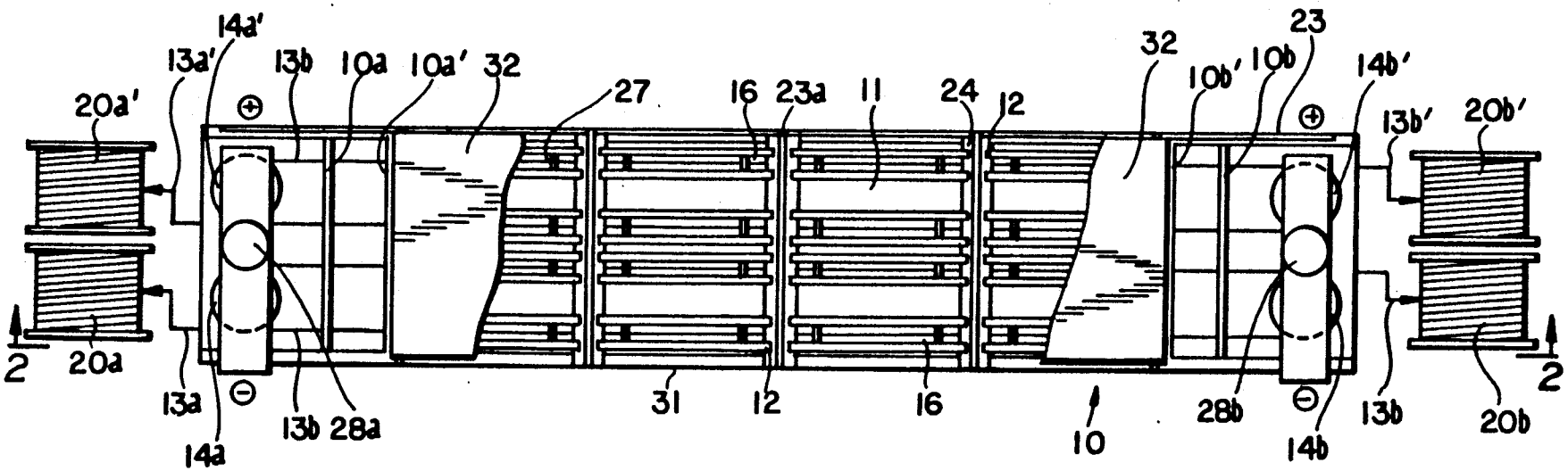
FIG. 1 illustrates the top view of one embodiment for the electrolytic plating of copper wire and the production of engrossed wire in accordance with the principles of the present invention.
Figure 2:
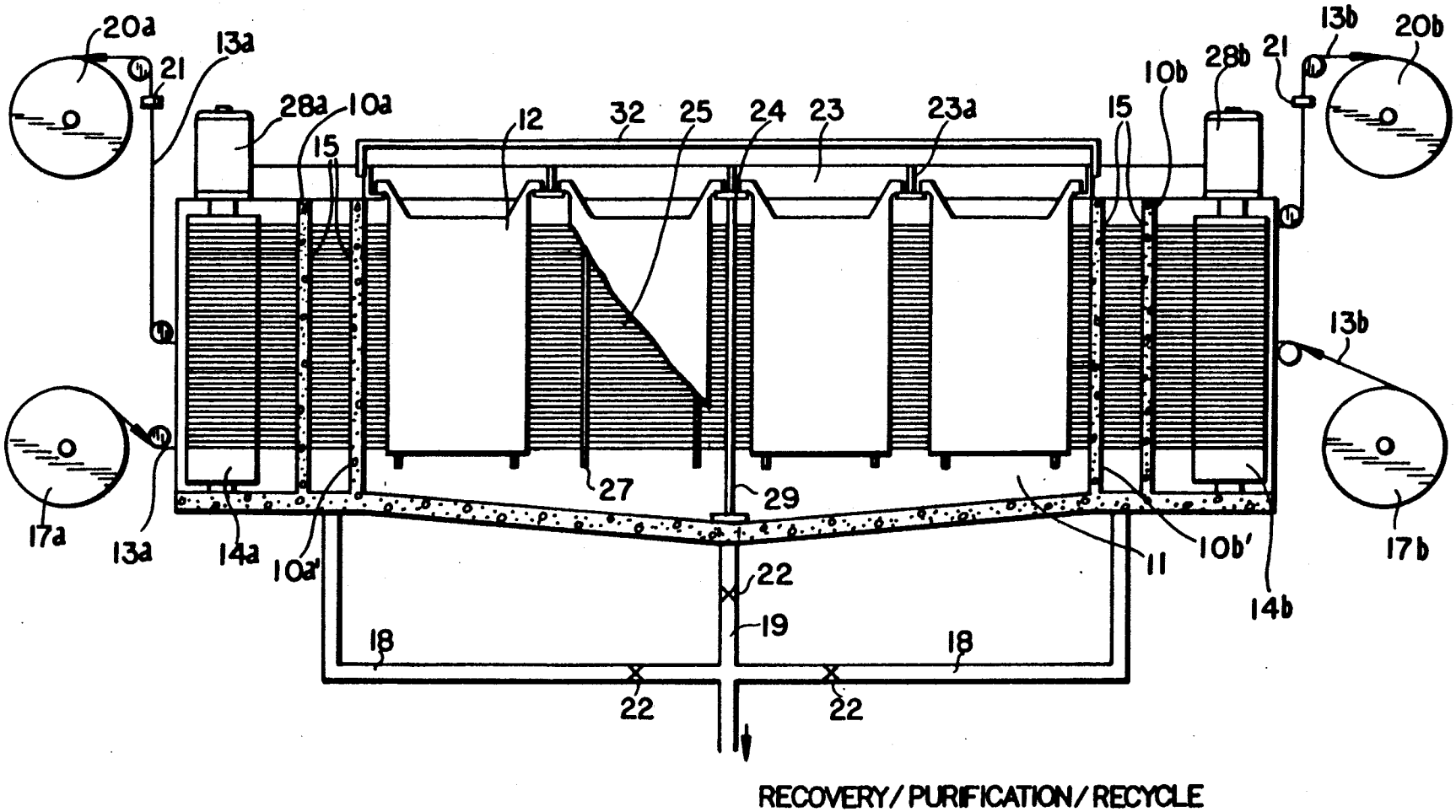
FIG. 2 illustrates a cross-sectional side view of said apparatus taken from the perspective of section 2—2 in FIG. 1.

FIGS. 1 and 2 illustrate top and side cross-sectional views of one embodiment of the present invention. References are made herein to all of these figures concurrently. The embodiments shown in the figures are only exemplary in nature, but the drawings and accompanying description illustrate the principles of the present invention. Similar numerals designate similar items in all figures.

A tank 10 made from a suitable material such as PVC, high density polyethylene, fiber reinforced polyester or other synthetic materials and polymer concrete and having end walls 10*a* and 10*b* and inside walls 10*a*, and 10*b*, holds the (electrolyte) electrolytic bath 11. A preferred material of construction is polymer concrete. Anodes 12 (groups of four are shown) are arranged in rows as in FIG. 1, forming uninterrupted parallel channels or passageways 16 for the wire 13 (shown as four (4) separate wires 13*a*, 13*a'*, 13*b* and 13*b'*) to pass through the tank. The anodes 12 may be of varying height to compensate for any sagging of wires 13 in the tank. A nonconductive separating means 27, e.g., strips, on the anode 12, usually up to 1" thick depending on the size of passageway 16 may be employed to minimize shorts caused by contact of the wire 13 with the anode 12. The strips may be placed in any convenient form on the anode—usually vertically or positioned above and below the wire curtain to keep the anodes spaced from the wire. Strips 27 are shown in FIGS. 1 and 2. Anode baskets may also be used as known in the art. Membranes may be employed between the wire 13 and anodes 12 to minimize sludge and or gas contamination of the wire. An anode buss bar 23 and connecting bars 23*a* provide electricity for the anodes 12 and are preferably removable with anode supports 24 to allow removal of the wire 13 for cleaning of the tank, repair of wire breaks, etc. FIG. 1 shows one electrolytic cell and when multiple cells are employed, groups or banks of each cell may be electrically wired in parallel circuit to allow repair of an individual cell or its auxiliary equipment.

Pure copper wires 13*a*, 13*a'*, 13*b* and 13*b'* are passed a plurality of times through the tank 10 and around sets of electrically conductive shafts 14 (shown as two (2) sets of shafts 14*a* and 14*a'*, and 14*b* and 14*b'*) forming four curtains 25 of wires. As shown in FIGS. 1 and 2, separate wires 13*a* and 13*b* are vertically disposed on the set of shafts 14*a* and 14*b* and separate wires 13*a*, and 13*b'* are vertically disposed on the set of shafts 14*a'* and 14*b'*. The electrically conductive shafts may be independently driven by motors 28 (shown as motors 28*a* and 28*b*). The shafts may be grooved for, among other advantages, ease of removal of the wire and the shafts from the tank as an integral unit to repair wire breaks, starting the process, etc. The starting base copper wires 13*a*, 13*a'*, 13*b* and 13*b'* act as cathodes and are delivered to the rotating shafts from payoff coils or reels 17 (shown as 17*a* and 17*b* with 17*a'* and 17*b'* not being shown), preferably twisted on the fly in order to impart axial rotation, and are transmitted thereby into and out of the tank a plurality of times through walls 10*a*, 10*a'*, 10*b* and 10*b'*. A double walled tank as shown in FIGS. 1 and 2 enables the electrolyte leaking out through walls 10*a'* and 10*b'* to be trapped in the double wall and recycled, e.g., to the tank 10 through pipes 18. Sludge and/or electrolyte may be removed through pipe 19 and valves 22 control flow of the electrolyte 11 or sludge to a recovery and/or purification section or recycled to tank 10. A bottom sloped tank 10 is shown which facilitates collection and removal of the sludge. The wires engrossed by the electrolytic action are taken off shafts 14 (shown as 14*a*, 14*a'*, 14*b* and 14*b'*) and wound in coils or reels on takeup 20 (shown as 20*a*, 20*a'*, 20*b* and 20*b'*) and may be driven by the same motors actuating the shafts on respective ends of the tank.

The tank walls 10*a* and 10*b* and 10*a'* and 10*b'* have openings 15 which may be of any configuration and size necessary to allow the wire to pass therethrough. Usually, for a circular wire the openings 15 will also be circular and of a size large enough to allow the wire to pass through without undue friction. For some applications however, it is desirable to enhance the electrolyte circulation in the tank, e.g., to minimize diffusion layer boundaries and thus inhibit current density effects, and the openings 15 in walls 10*a'* and 10*b'* are specially sized to permit the passage of electrolyte therethrough at controlled rates. The size of the openings 15 may, for example, increase from the bottom to the top of tank 10 to generate a uniform flow pattern in the tank. The wire-electrolyte interphase may also be agitated by, e.g., resonance vibrations of the wires in the curtains. A slit in the walls 10*a'* and 10*b'* may also be used instead of discrete openings, the width of the slit also may increase toward the top of the tank for a uniform electrolyte flow. For embodiments from which the wire and external drive shafts may be removed from the tank as an integral unit as discussed above the walls 10*a*, 10*a'*, 10*b* and 10*b'* will have slits to enable removal from the tank.

Another feature of the invention is to prevent electrodeposition on the wire 13 until the wire is effectively cleaned, for example, by the action of the electrolyte, e.g., by one or more such passes through the tank 10. This may be accomplished, for example, by passing each wire 13 entering the tank 10 through a dielectric conduit (pipe) positioned in the tank or by passing the wire above or below the effective anode surface.

A hoist used to replace the corroded (depleted) anodes is not shown in the figures. With regard to replacing the anodes, it is preferred to protect the cathode wire curtains 25 by shielding them during the replacement operation by, for example, inserting inverted U-shaped nonconductive protectors over the wire curtains during anode replacement.

Figure 3:
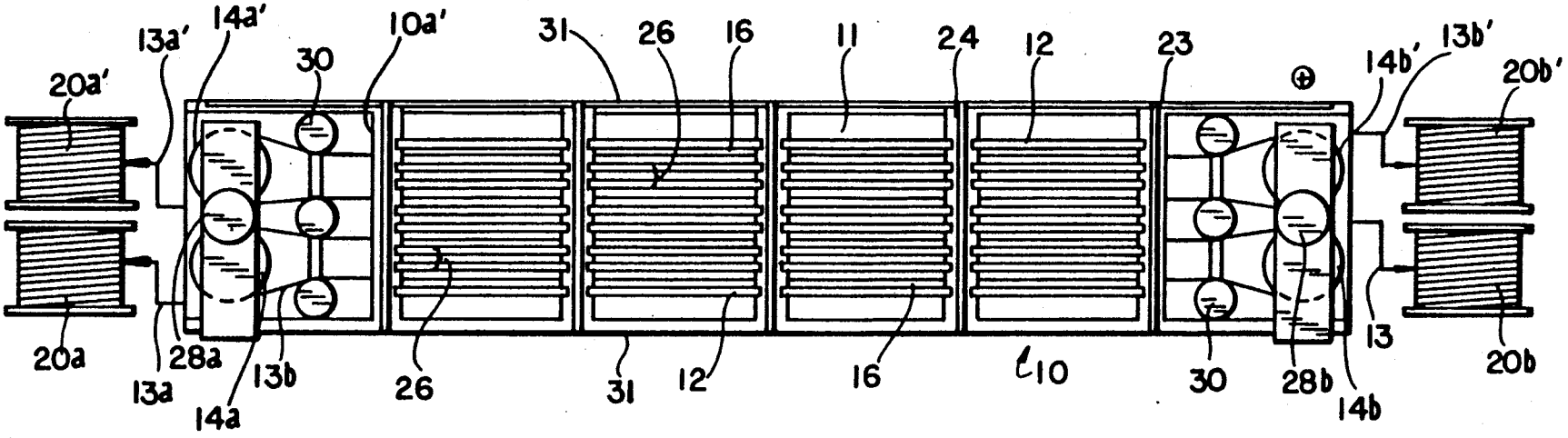
FIG. 3 illustrates the top view of another embodiment of the invention.

FIG. 3 shows an embodiment of the invention wherein the wires to be engrossed are passed around auxiliary converging rollers 30 which act to equalize stretching of the wire and to alter the direction of the wires and consequently, alter the spacings of the wires 13 in the tank 10 relative to the anodes 12 and tank side walls 31. For many processes a close anode to wire spacing is desirable, e.g., to reduce the electrical energy required to produce a unit of engrossed copper by minimizing the voltage drop through the bath. The converging rollers 30 may be movable or size interchangeable to control the anode-cathode spacings. Spacing may also be controlled by positioning the anodes on the anode supports 24. In one embodiment, double rows of anodes 26 (as shown in FIG. 3) may be used to form passageways 16, with each row being positioned laterally relative to the wire curtains for maximum current efficiency. The anodes may also be moved during the process to maintain the desired anode-cathode spacing. This variable anode-cathode spacing also has the effect of minimizing ohmic heating which causes the temperature of the electrolyte to increase.

However, when the employed current density and/or the electrical resistance through the bath are relatively low the electrolyte losing heat by convection to the ambient air cools from its normal temperature of about 50° to 60° C. In one embodiment thermic covers 32 are provided as shown in FIG. 1 (partially) and FIG. 2 (the complete cover) to cover the top of the tank during operation and if being used to electrowin copper, such covers additionally can be semi- permanently affixed thereby effectively controlling the bothersome acid mist resulting from the liberation of oxygen at the anodes.

FIG. 2 also shows vertical support 29 usually located at about the mid center of the tank in each passageway and made from PVC or other suitable material and having apertures to thread the wires therethrough and act to stabilize the position of the curtains.

Figure 4:
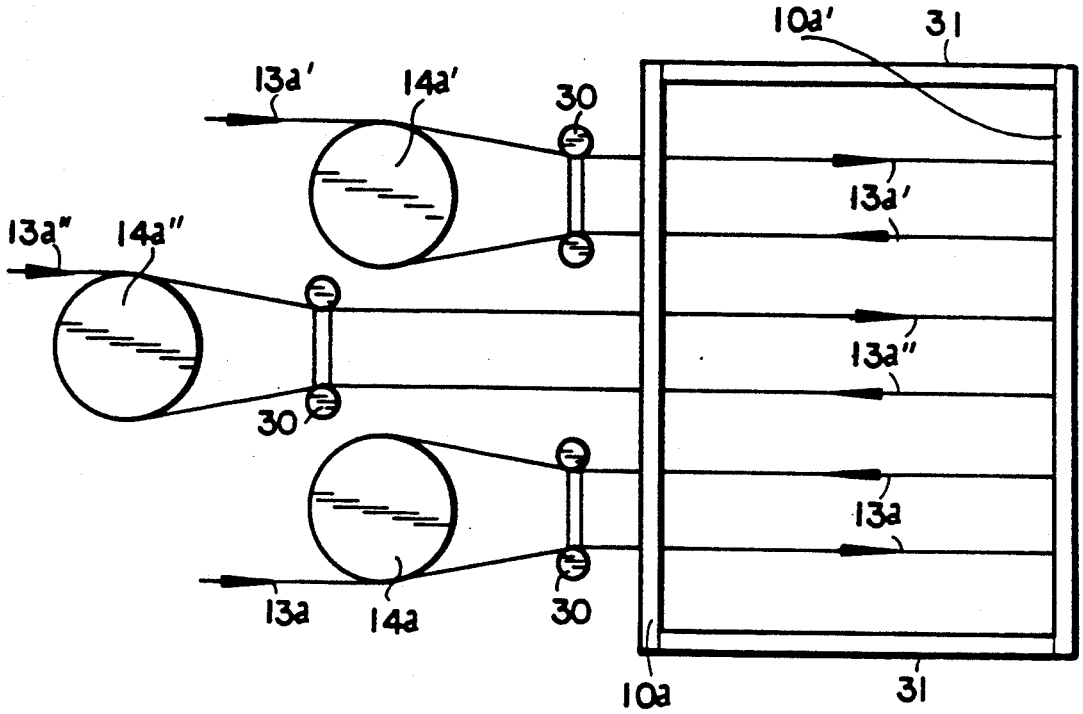
FIG. 4 illustrates the top view of an embodiment of the invention showing only the wire converging rollers and multiple external triangularly placed drive shafts.

In another embodiment, converging rollers 30 may be used in conjunction with triangular spacing of the external shafts 14 and with spacing of the anodes 12 to enable minimization of the tank size needed to produce the engrossed wire. FIG. 4 shows such a configuration using additional shaft 14*a''* and wire 13*a''* (note there is only one wire on each shaft) and it will be noted that the tank size needed to engross the wires may be less than other configurations not employing converging rollers 30 and spaced external shafts 14, particularly triangularly spaced, since the wires are packed horizontally closer together.

According to this aspect of the invention, it is advantageous to maximize the cathodic surface area exposed to electrolysis in a given section of tank in order to minimize the capital cost of the commercial installation and optimize the efficiency of the system. In this regard, it is economically advantageous to optimize the vertical distance between the wires in a curtain and the spacing between each wire curtain and the adjacent anode. For a given anode current density, as defined in the beginning of this disclosure, the foregoing concepts result in the highest quality deposit of copper on the starting wire and the most cost effective operation of the system. Expressed in different terms, an important objective of the invention is to design the system so that the ratio of cathode current density to anode current density which is typically greater than 1, is minimized and is typically less than 15, preferably between 1 and 10. For example, a system employing a cathode current density of 120 amps/ft$^2$ and an anode current density of 18 amps/ft$^2$ has demonstrated to be practical and suitable.

Figure 5:
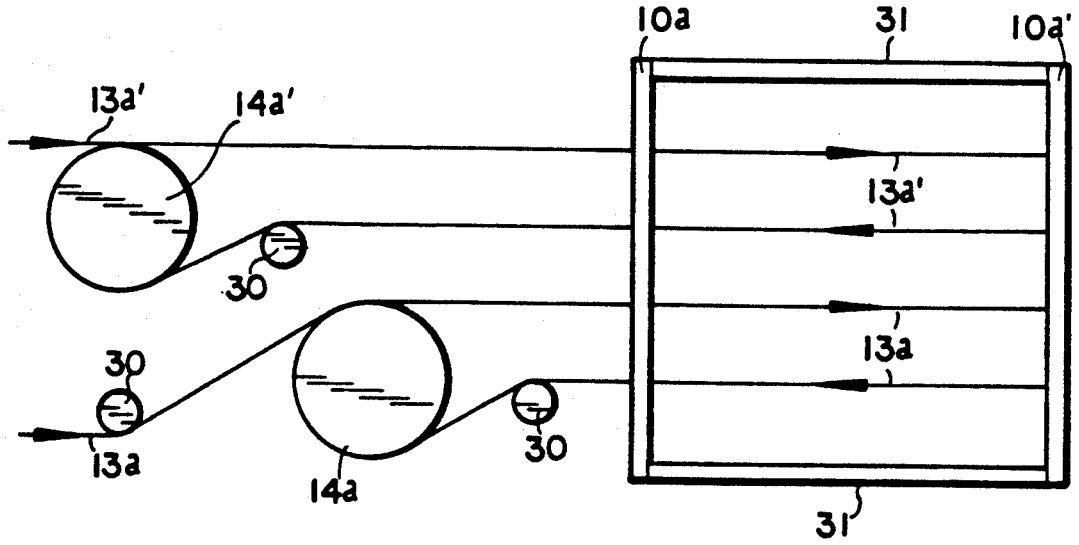
FIG. 5 is a top view of an embodiment of the invention showing multiple external drive shafts employing converging rollers and drive shafts angularly disposed to the axis of the tank.

An alternative embodiment of the invention wherein the number of wire curtains in a given tank is maximized is shown in FIG. 5. The external shafts 14 (14*a* and 14*a'*) are aligned on an axis angularly disposed to the longitudinal dimension of the tank. Converging rollers 30 are placed to direct the wires 13*a* and 13*a'* (note there is only one wire on each shaft) in a parallel closely spaced disposition.

Although the size of the tank 10, wires 13, sets of shafts 14 and number of anodes 12 may vary widely, it is expected that most users will employ starting wires up to about 4 mm diameter, usually 1 to 2 mm diameter and produce finished wires up to about 6 mm diameter usually about 2 to 4 mm diameter. A preferred engrossment of the wire is up to about 150%, based on the weight of the starting wire. Usually the wire will be engrossed about 25% to 200% or more, e.g., 100% to 150%.

While the embodiments shown in FIGS. 1–3 employ two sets of shafts and two starting wires on each set of shafts, a single wire or additional wires may also be engrossed on each set of shafts and/or by utilizing additional sets of shafts and anodes 12 as shown in FIG. 4.

The size of the tank 10 will vary depending on the engrossment desired and the number of wires to be simultaneously electroplated, as well as on the throughput to be achieved. For a design as shown in FIG. 1, the length of the tank 10 may be up to 40 feet, or longer and up to 5 feet high, or higher. The drive shafts 14, 14*a*', etc., are preferably made of an electrical conductive corrosion resistant material such as copper or stainless steel and are up to about 600 mm diameter. The wire speed through the cell can vary substantially depending on the length of the cell, the number of starting wires, the degree of engrossment and the current density used.

It is an important feature of the invention that the shaft diameter be correlated to the wire size and the degree of engrossment to avoid undue stresses which may cause breaking of the wire during the engrossment process. In general, the ratio of the shaft diameter to the engrossed thickness of the electrodeposit defined as the final diameter minus the starting diameter value divided by two will be greater than about 100.

The following TABLE 1 shows some sample wire engrossments for a starting wire of AWG 15 (1.45 mm) and the resulting shaft diameter to plating thickness ratio (Ratio).

TABLE 1

| Finish Diameter (mm) | Plating Thickness (A) (mm) | % Engrossment | Ratio (B/A) Shaft Diameter (B) 101.6 mm | 304.8 mm |
|---|---|---|---|---|
| 1.776 | .163 | 50 | 626 | 1878 |
| 2.292 | .421 | 150 | 241 | 723 |
| 2.511 | .531 | 200 | 191 | 573 |

For the preferred mode of operation, the wire will be engrossed from a wire size of about 1 to 2 mm to a finished wire size of about 1.8 to 3.2 mm. The preferred shaft diameter is about 100 to 350 mm.

Increased throughput and operating efficiencies will generally result by increasing the number of wire windings on the shafts 14 for each wire size being engrossed and the number of windings per shaft is limited by the current capacity of shaft contact. Generally, up to about 160 windings per starting wire may be employed. A center to center vertical wire spacing of the wires forming the curtains in the cathode passageways 16 of up to about 20 mm may be used with a spacing of about 2 to 14 mm, e.g., 5 to 12, generally employed.

It may be desired for many applications to monitor the current efficiency of the process by continually measuring the diameter of the wire at in least one point in the process. Commercially available optical or laser devices 21 such as a Contrologic noncontact gauging device would measure the wire diameter and compare the measured value with a predetermined value. Based on the comparison, the current efficiency can be determined and appropriate action taken when the current efficiency is less than a desired level. For example, the current efficiency is affected by shorting between the anode and the cathode and by the composition of the electrolyte and a low value may be compensated for by temporarily reducing the wire speed until the cause of the low current efficiency is corrected.

Another process control feature monitors the wire feed speed and the wire removal speed for breakage detection. Based on a comparison of these two speeds, breakage may be detected and corrective action taken. Wire tension measurement and the monitoring of electrical conductivity may also be employed as a process control features.

It is another embodiment of the invention to wash the wire 13 when exiting the tank 10 (past walls 10*a* and 10*b*) and to employ the wash water to wash the shafts 14 by, for example, flooding. This has the effect of cleaning the wires and also of keeping the shafts free of metallic build-up and reducing the electrical resistance of the wire to shaft contact. Wires exiting tank 10 for take-up on reels or coils 20 are preferably air vacuum dried.

Another feature of the invention utilizes annealing of the wire in at least one point during the process. The annealing tends to modify the crystal structure of both the starting wire and the plated copper resulting in a process which has increased operating efficiencies (less wire breaks, etc.) and which produces a plated product having enhanced physical and electrical properties. The conventional annealer is not shown and annealing will generally be performed on the engrossed wire which wire will then be drawn to the desired size for sale and/or as feed wire for the process. It is also contemplated to perform annealing and drawing operations between cells providing a stepwise process to obtain the desired sized finished product.

We claim:

1. An apparatus for producing copper wire by electrodepositing copper onto a starting copper wire said apparatus comprising:

(a) tank means for holding an electrolytic bath;

(b) anode means in said bath forming passageways along the length of the tank;

(c) one set of two drive shafts each positioned externally at opposite ends of the tank means and being used to transport at least two starting wires through the passageways in the tank means by the wires being fed to the shafts and wound in a continuous manner about the shafts and extending back and forth therebetween and through the tank means and means for withdrawing the wires electrodeposited with copper;

(d) means for applying an electrical current between the anode means and the copper wires acting as cathode means; and (e) means for feeding the starting wires and for collecting the electrodeposited copper wire.

2. The apparatus of claim 1 wherein the tank means is doubled walled at the ends with openings in the inner walls for the wires to pass through and the shafts are positioned to provide a substantially parallel path for the wire in the passageways of the tank means.

3. The apparatus of claim 1 wherein the anode means are spaced to provide a single anode row adjacent each length of wire as it passes through the tank means.

4. The apparatus of claim 3 wherein there is a double anode row in the space between lengths of the wire passing through the tank means except in the passages adjacent the side walls of the tank.

5. The apparatus of claim 1 wherein auxiliary converging shafts are provided between the drive shafts and the tank means to alter the path of the wire in the tank means and to decrease the distance between said wire paths.

6. The apparatus of claim 1 wherein the anode means have nonconductive separating means thereon.

7. The apparatus of claim 6 wherein the starting wires are fed from flyer pay-offs.

8. The apparatus of claim 7 wherein dielectric conduit pipes are positioned in the course of the first passage of each starting wire through the tank and inserting the wire therethrough.

9. The apparatus of claim 8 wherein inverted U-shaped nonconductive protectors are placed vertically about the horizontal paths of the wires in each passageway in the tank.

10. The apparatus of claim 9 wherein a vertical support means with apertures is provided in the tank through which the wire lengths are threaded through.

11. The apparatus of claim 10 wherein thermal insulating sealed means are provided on the top of the tank.

12. A method for producing copper wire by electrodepositing copper onto a starting copper wire comprising:

(a) providing a bath of electrolytic fluid with dissolved copper therein;

(b) providing a plurality of anode means arranged in spaced and parallel relation with respect to one another in said bath and defining spaced parallel passageways;

(c) providing a set of external drive shafts, each shaft being positioned at opposite ends of the tank;

(d) introducing at least two starting copper wires into said bath on the set of drive shafts and threading said wires through the bath and along the passageways with each wire traversing the passageways between the set of shafts;

(e) continuously passing each wire through said bath between the set of shafts including the steps of withdrawing each wire from the bath after each passageway is traversed and reintroducing each wire a plurality of times into said bath so that copper is electrodeposited on each wire as it travels along each corresponding passageway between the shafts;

(f) simultaneously applying an electrical current to each starting wire and to said anode means so that the wires act as a cathode and copper ions are electrodeposited on the wires, thereby progressively increasing the cross-sectional area thereof; and (g) continuously withdrawing the engrossed copper wires from said bath as they reach the desired engrossed size.

13. The method of reintroducing into said electrolytic tank the wire produced by the method of claim 12 after it has been drawn and annealed and again engrossing it to a desired finished size.

14. The method of claim 12 comprising water washing of the engrossed wire or wires issuing from the electrolytic tank and employing the wash water to wash the external shafts.

15. The method of claim 12 comprising continuously monitoring the engrossed wire size as it issues from the tank.

16. The method of claim 12 comprising continuously monitoring the electrical conductivity of the engrossed wire as it issues from the tank.

17. The method of claim 12 wherein the electrolytically engrossed wires are drawn and or annealed using as lubricant or cooling means a solution containing some of the reagents or additives normally incorporated into the electrolyte during copper electro-refining or electrowinning operations.

18. The method of claim 12 wherein the wire is engrossed up to about 200% by weight of the starting wire.

19. The method of claim 12 wherein the ratio of the shaft diameter to the engrossed thickness of the electrodeposit is greater than about 100.

20. The method of claim 12 wherein the ratio of the cathode current density to anode current density is less than about 15.

21. The copper wire produced using the method of claim 12.

22. An apparatus for producing copper wire by electrodepositing copper onto a starting copper wire said apparatus comprising:

(a) tank means for holding an electrolytic bath;

(b) anode means in said bath forming passageways along the length of the tank;

(c) multiple sets of drive shafts, each set of two shafts being positioned externally at opposite ends of the tank means and each set of shafts being used to transport at least one wire through the corresponding passageways in the tank means by the wire or wires being fed to each pair of shafts and wound in a continuous manner about the respective shafts and extending back and forth therebetween and through the tank means and means for withdrawing the electrodeposited wire from each set of shafts;

(d) means for applying an electrical current between the anode means and the copper wires acting as cathode means; and (e) means for feeding the starting wires and for collecting the electrodeposited copper wire.

23. The apparatus of claim 22 wherein the tank means is doubled walled at the ends with openings in the inner walls for the wires to pass through and each set of shafts is positioned to provide a substantially parallel path for the wire in the passageways of the tank means.

24. The apparatus of claim 22 wherein the anode means are spaced to provide a single row of anodes adjacent each length of the wire as it passes through the tank means.

25. The apparatus of claim 24 wherein there is a double row of anodes in the space between lengths of the wire passing through the tank means except in the passageways adjacent the side walls of the tank.

26. The apparatus of claim 22 wherein auxiliary converging shafts are provided between the drive shafts and the tank means to alter the path of the wire in the tank means and to decrease the distance between said wire paths.

27. The apparatus of claim 22 wherein the anode means have a nonconductive separating means thereon.

28. The apparatus of claim 23 wherein there is a slit in the inner walls of the tank to enable removal of the drive shafts and wires as an integral unit from the tank.

29. The apparatus of claim 28 wherein the drive shafts have grooves.

30. The apparatus of claim 26 wherein there are at least three sets of drive shafts and the drive shafts are triangularly disposed.

31. The apparatus of claim 26 wherein the drive shafts are angularly disposed to the longitudinal dimension of the tank.

32. A method for producing copper wire by electrodepositing copper onto a starting copper wire comprising:

(a) providing a bath of electrolytic fluid with dissolved copper therein;

(b) providing a plurality of anode means arranged in spaced and parallel relation with respect to one another in said bath and defining spaced parallel passageways;

(c) providing at least two sets of two external drive shafts each, the shafts of each set being positioned at opposite ends of the tank;

(d) introducing at least one starting copper wire into said bath on each set of external drive shafts and threading said wires through the bath and along the passageways with each wire traversing the passageways between the set of shafts;

(e) continuously passing each wire through said bath between each set of shafts including the steps of withdrawing each wire from the bath after each passageway is traversed and reintroducing each wire a plurality of times into said bath so that copper is electrodeposited on each wire as it travels along each passageway between the shafts; and (f) simultaneously applying an electrical current to each starting wire and to said anode means so that the wires act as a cathode and copper ions are electrodeposited on the wires, thereby progressively increasing the cross-sectional area thereof; and (g) continuously withdrawing the engrossed copper wires from said bath as they reach the desired engrossed size.

33. The method of reintroducing into said electrolytic tank the wire produced by the method of claim 32 after it has been drawn and annealed and again engrossing it to a desired finished size.

34. The method of claim 32 comprising water washing of the engrossed wire or wires issuing from the electrolytic tank and employing the wash water to wash the external shafts.

35. The method of claim 32 comprising continuously monitoring the engrossed wire size as it issues from the tank.

36. The method of claim 32 comprising continuously monitoring the electrical conductivity of the engrossed wire as it issues from the tank.

37. The method of claim 32 wherein the electrolytically engrossed wires are drawn and/or annealed using as lubricant or cooling means a solution containing some of the reagents or additives normally incorporated to the electrolyte during copper electro-refining or electrowinning operations.

38. The method of claim 32 wherein the wire is engrossed up to about 200% by weight of the starting wire.

39. The method of claim 32 wherein the ratio of the shaft diameter to the engrossed thickness of the electrodeposit is greater than about 100.

40. The method of claim 32 wherein the ratio of the cathode current density to anode current density is less than about 15.

41. The copper wire produced using the method of claim 32.

* * * * *

UNITED STATES PATENT AND TRADEMARK OFFICE

CERTIFICATE OF CORRECTION

PATENT NO. : 5,242,571

DATED : September 7, 1993

INVENTOR(S) : Carlos E. Roggero Sein, et al.

It is certified that error appears in the above-indentified patent and that said Letters Patent is hereby corrected as shown below:

Title page, item [75], Inventors: "Carlos E. R. Sein" should read --Carlos E. Roggero Sein--; add: --Larry A. Davis, Kearney, Arizona--. Column 4, line 4, "10a," second occurrence, should read --10a'--; line 5, "10b," should read --10b'--; line 38, "13a," should read --13a'--.

Signed and Sealed this

Fifteenth Day of March, 1994

*Attest:*

*Attesting Officer*

Bruce Lehman

BRUCE LEHMAN

*Commissioner of Patents and Trademarks*